US005186348A

United States Patent [19]

Steiner

[11] Patent Number: 5,186,348

[45] Date of Patent: Feb. 16, 1993

[54] CAN END WITH LOCK OPEN AND LOCK CLOSED TAB OPERATED BY A PULL RING

[75] Inventor: Joseph D. Steiner, Coraopolis, Pa.

[73] Assignee: Can Do Associates, Pittsburgh, Pa.

[21] Appl. No.: 690,706

[22] Filed: Apr. 24, 1991

[51] Int. Cl.[5] ..... B65D 17/34; B65D 43/24

[52] U.S. Cl. ..... 220/270; 220/269; 220/335

[58] Field of Search ..... 220/270, 268, 269, 318, 220/335, 307

[56] References Cited

U.S. PATENT DOCUMENTS

| | | | |
|---|---|---|---|
| 3,325,043 | 6/1967 | Henchert et al. | 220/270 |
| 3,370,169 | 2/1968 | Bozek | 220/270 |
| 3,441,168 | 4/1969 | Luviano | 220/270 |
| 3,780,902 | 12/1973 | Holc et al. | 220/270 |
| 3,847,300 | 11/1974 | Waters | 220/269 |
| 3,952,911 | 4/1976 | Bozek et al. | 220/269 |
| 4,203,528 | 5/1980 | Hasegawa | 220/269 |
| 4,231,487 | 11/1980 | Hasegawa | 220/269 |
| 4,232,797 | 11/1980 | Waterbury | 220/359 |
| 4,244,488 | 1/1981 | Fridl et al. | 220/260 |
| 4,253,582 | 3/1981 | Shields | 220/269 |
| 4,407,424 | 10/1983 | Heyn | 220/269 |
| 4,537,326 | 8/1985 | Morehead | 220/269 |
| 4,624,386 | 11/1986 | Grigorenko et al. | 220/269 |
| 4,687,116 | 8/1987 | Dutt et al. | 220/270 |
| 4,760,934 | 8/1988 | Netsch | 220/269 |
| 4,951,835 | 8/1990 | DeMacs et al. | 220/269 |

*Primary Examiner*—Allan N. Shoap
*Assistant Examiner*—Vanessa Caretto
*Attorney, Agent, or Firm*—Clifford A. Poff

[57] ABSTRACT

The present invention provides a beverage container lid which can be attached to a beverage container by a skirt extending about the periphery of the lid. In the body of the lid there is defined by a score line a tear tab with a blunt nose portion. The score line extends along opposite lateral sides to a termination site at opposite sides of a hinge situated in an internal area of the lid body. The hinge retains the tear tab as an integral part with the container line while the tab is controlled as to severing from the remaining part of the lid body by the score lines through operation of a pull ring. The pull ring is hinged to the tear tab generally opposite the hinge between the tab and the lid body so that the ring can be used to readily fracture the tear tab about the score line. The ring is used in conjuction with clips for holding and maintaining the tear tab in an opened as well as a closed position. The clips for engaging with the pull ring to hold the tab is closed position are uniquely situated in relation to the hinge connection between the pull ring and the tear tab so that the tear tab can assume a closed position from its original site with good fluid tight integrity.

13 Claims, 2 Drawing Sheets

CAN END WITH LOCK OPEN AND LOCK CLOSED TAB OPERATED BY A PULL RING

BACKGROUND OF THE INVENTION

1. Field of the Invention

This invention relates to the beverage container lid having a skirt for attachment to the rim of a beverage container and, more particularly to such a lid provided with a lid body having score lines defining a tear tab hinged at its inboard side to the lid body and hinged at its outboard side to a tab control ring used to move and hold a tab in opened and closed positions.

2. Description of the Prior Art

It is well known to provide a self-contained structure in a can lid for forming an opening using a predefined score line to gain access to the contents of the can. In a design where a pull tab and tear flap are joined together and torn free of the lid, the pull tab and tear flap give rise to a loose piece which might not be properly disposed of in a suitable trash container and may find its way as litter in the environment. The loose piece might be inserted into the opening in the container and could be ingested with the contents of the container. Other designs of the tear flap for a lid of a beverage container includes a score line that can be fractured to form a tab section displacable into the interior of the can body without disconnecting the tab section from the remainder of the lid so as to avoid the possible ingestion of a loose small lid part. The problem, however, with this type of construction is that any contaminates, solid or liquid, on the container top may find their way to the contents in the container thus contaminating the contents of the container. In both of these known pull tab constructions for a container, the opening to the container once open is not recloseable. There have been suggestions, however, to provide a container top construction which will enable re-closure of the opening at the users will. One such container top arrangement is shown in the U.S. Pat. No. 4,363,419 in which there is a pull tab with a finger size circular ring portion supported by a pull tab mounting portion permanently attached to the thin wall cover at the end of a can. A relatively small flap actuating portion is located adjacent to a circular flap portion to break open the flap portion and then rotate the flap portion inwardly of the can to form a circular access opening in the cover. The flap portion can be moved to cover the opening in the cover while remaining permanently attached to the cover.

U.S. Pat. No. 4,760,934 discloses a beverage container lid having a foldable tear strip flap that may be fastened and held in an open position by pressing the flap into a mating recess in the lid. When the tab is returned to a closed position, the tab is fitted between the raw torn edges of the lid. This arrangement suffers from the disadvantage that accidental toppling of the beverage container will allow the contents of the container to apply sufficient pressure to move the tear strip flap to an open position. Also, the tear strip flap can not be assumed to be maintained in a re-closed position with long continued integrity. It is believed metal fatigue of this tear strip flap will detrimentally affect re-closing of the flap in the lid recess.

In U.S. Pat. No. 4,301,940 a pull tab and a tear strip remain fully locked onto a can end without the strip dipping into the beverage in the can. The can strip is broken loose from the can top by operation of a pull handle and thereafter the tear strip is rolled on the pull handle as the tear strip is released from the can top until a storage site is found at the center part of the can top.

An advantage therefore exists for the can top construction that will allow opening and re-closing with consistent and reliable operation of a tear tab.

Accordingly, it is an object of the present invention to provide an improved can lid construction that provides a tear tab which remains an integral part of the can and while at the same time the tear tab can be repeatedly positioned in a closed position with fluid tight integrity and allow the tab to be latched in an open position for convenient access to interior of a beverage container.

SUMMARY OF THE INVENTION

More particular according to the present invention there is a beverage container lid for a beverage container wherein the container lid comprises a lid body surrounded by a peripheral skirt for seating attachment to a rim of a beverage container, a tear tab defined by a score line in the lid body extending from a blunt nose portion radially inward along spaced apart paths to inboard termination sites at opposite sides of an inboard hinge joined to the lid body, a tab control ring hinged to an outboard part of the tear tab opposite the inboard hinge for controllably positioning the tear tab, and means upstanding from the lid body at preselected sites to releasable engage the tab control ring for holding the tear tab in closed and re-closed positions relative to the opening formed by severing the tear tab along the score lines in the lid body. In the preferred form of the present invention, there are provided first and second means in the form of spaced apart pairs of tabs to releasable engage the control ring for holding the tear tab in either of an open or a closed position relative to the opening formed along the score line. One pair of these tabs holds the tear tab closed and engages the inboard facing edge of the tab control ring. The inboard hinge preferably includes a spacer bar between spaced apart hinge lines formed in the lid body. An outboard hinge and locking ring tabs are used for holding the tear tab to the control ring. The outboard hinge is attached to the outboard side of the control ring when the tear tab is positioned to close the access opening in the lid body.

BRIEF DESCRIPTION OF THE DRAWINGS

These features and advantages of the present invention as well as others will be more fully understood when the following description is read in light of the accompanied drawings in which.

DESCRIPTION OF THE PREFERRED EMBODIMENTS

Figure 1:
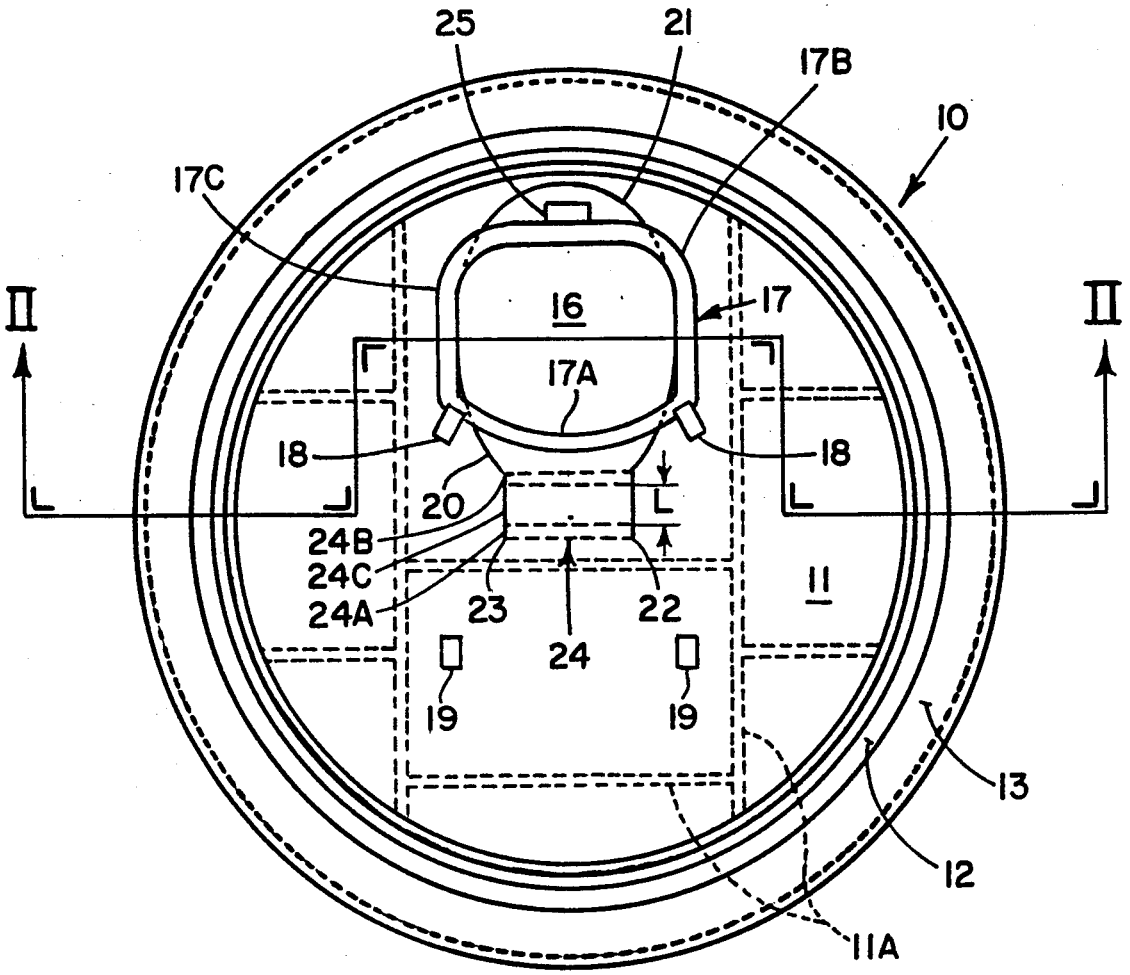
FIG. 1 is a top plane view of a container and wall for a beverage can embodying the features of the present invention.
Figure 2:
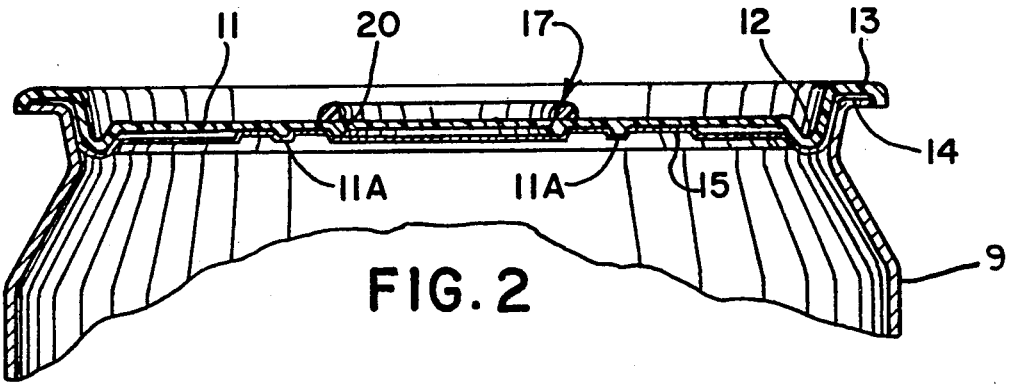
FIG. 2 is a sectional view taken along lines II—II of FIG. 1.

In FIGS. 1 and 2 there is illustrated the preferred embodiment of a beverage can lid embodying the features of the present invention. The construction of the lid including the component sections are shown in a position corresponding to an origin of manufacture. As shown, the lid 10 includes a central disk shaped lid body 11 joined by a U-shaped channel section 12 to skirt section 13 which extends about the outer periphery of the lid body for attachment of the container lid to a beverage container body 9. The attachment of the lid 10 to container 9 is carried out by seating an upper rim portion of the container body into a pocket area 14 and adhering through suitable adhesives or a deforming operating, per se well known in the art, to form a hermetically sealed assembly. When desired, to reliably seal a content under pressure in the container, a thin film or layer 15 is applied to the face surface of the lid prior to sealing the container lid to the beverage container body. Layer 15 is applied during the lid molding process or subsequent thereto as desired. Such a barrier film is per se well known in the art. The container lid of the present invention is preferably made of plastic material having a composition including a component of suitable plastics and, if desired, coloring agents that are chosen for the objectives of strength, appearance, suitability and other factors as is readily understood by those skilled in this art. The under surface of the lid body 11 is formed with raised rib like protrusions 11A of suitable height and in a rectangular pattern, as shown, so as to strengthen, as needed, the remaining planer disk like configuration of the lid body.

When the lid of the present invention is placed on a beverage container, the exposed lid body surface contains a tear tab 16 and a tab control ring 17 as well as pairs of locking ring tabs 18 and 19; all preferably formed integral with and as part of the molded plastic configuration of the lid body. The tear tab 16 is defined by a score line 20 which extends from a blunt nose portion 21 at an outer peripheral margin of the lid body and therefrom along sites that are generally radially inward of the lid body at spaced apart paths to inboard termination sites 22 and 23 which are at opposite sides of an inboard hinge assembly 24. The hinge assembly 24 is made up of hinge recesses 24A and 24B which are on the underside of the lid body and are spaced apart by a distance to provide a hinge bar 24C whose height, designed by reference character L in FIG. 1, is specifically chosen for a purpose that will be explained in greater detail hereinafter. The site of the hinge assembly 24 is at the circular center of the disk shaped configuration of the lid body. The score line follows a path that is generally radial in direction whereby a nose portion 21, which spaced from the outer periphery edge of the lid body, is adjacent the skirt 13. An outboard hinge 25 is formed by a web of plastic material that bridges the outer peripheral edge of the tab control ring 17 and the planar top surface of the tear tab 16. As can be seen in FIG. 1, the site of hinge 25 is generally opposite to the site of hinge assembly 24 with respect to the tab control ring 17.

Figure 3:
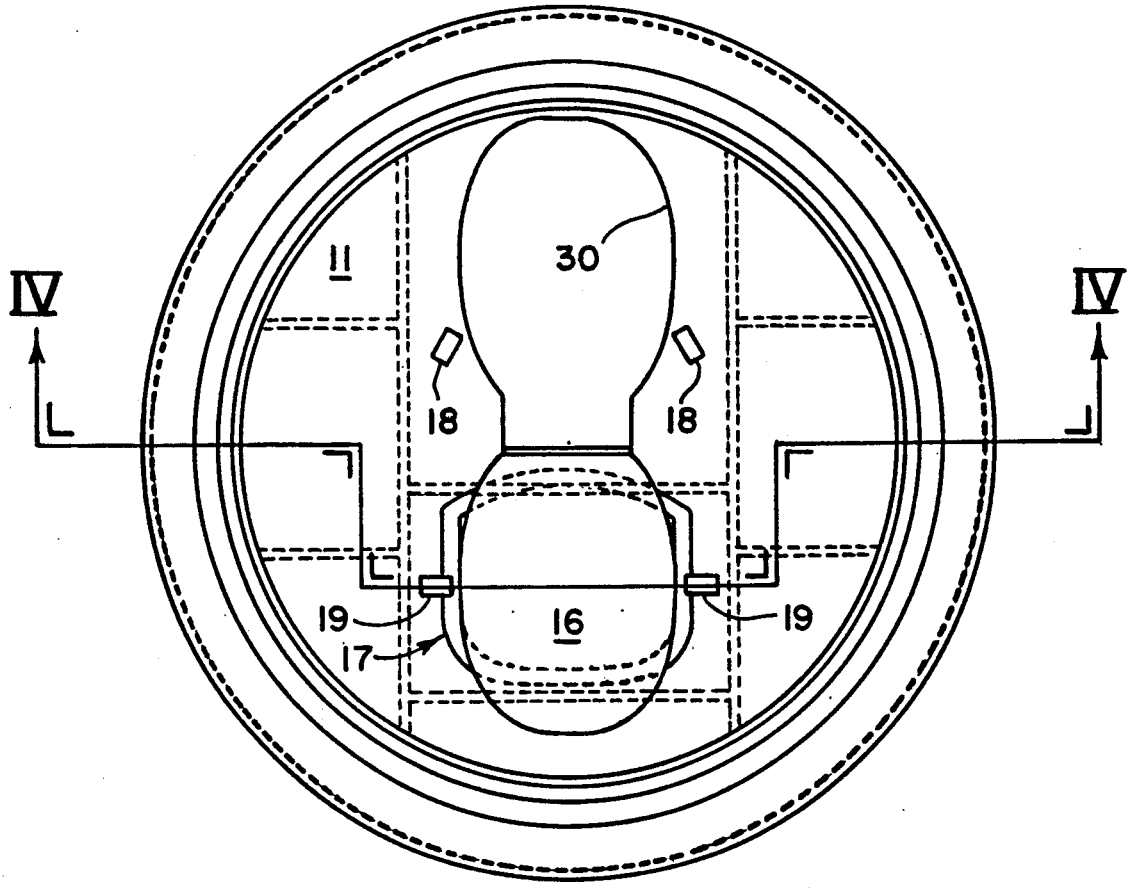
FIG. 3 is a plane view similar to FIG. 1 and illustrating the tear tab and tab control ring of the present invention holding the tear tab away from the opening in the lid body.
Figure 4:
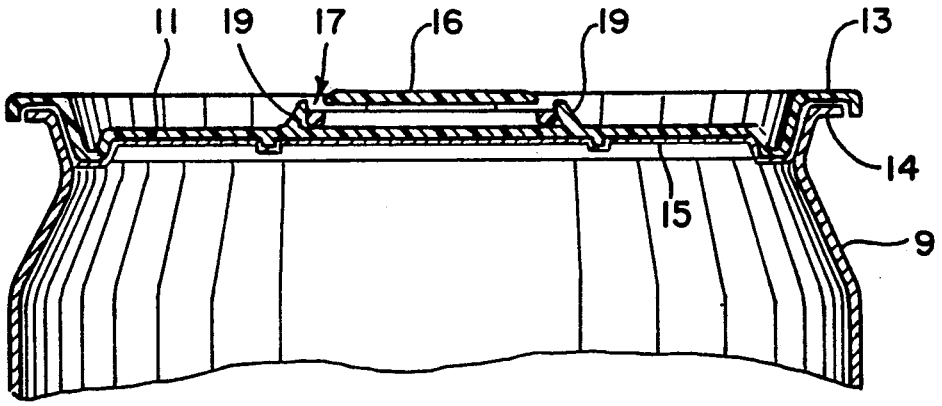
FIG. 4 is a sectional view taken along lines of IV—IV of FIG. 3.

In order to gain access to the interior of the beverage container through the container lid of the present invention, and as shown in FIG. 3 and 4, the tab control ring 17 is first lifted by grasping a bar section 17A so as to swing the tab control ring about hinge 25 into a position where the operator can firmly grasp the control ring with sufficient integrity to apply a force that will fracture the tear tab along the score line 20. As the motion of the control ring is continued, the tear tab is caused to assume a position that is generally upstanding with respect to the remaining upper planar face of the lid body. Thereupon, the tab control ring is swung back against the planar face surface of the tear tab and the tear tab is moved by continued swinging movement about hinge assembly 24 until the opposite lateral sides 17B and 17C of the tab control ring snap into a snugly fitting relation between the upstanding locking tabs 19. The height L of hinge bar 24C is such that hinge assembly can accommodate and generally corresponds to the thickness of the tab control ring when the tear tab 16 is swung into an overlying relation over the tab control ring as shown. In this position of parts as shown in FIG. 3, the tear tab is held in an open position by the latched relation between the sides 17B, 17C and tabs 19. This allows the unimpeded access to the opening formed by the portion of lid material displaced and conforming to the tear tab in the lid body. The opening is identified in FIG. 3 by reference numeral 30.

When it is desired to re-close the opening 30 as may be desired for any one of a number of different reasons, the tab control ring 17 is pried loose from the secured connection between tabs 19 as shown in FIG. 3 so as to allow the tear tab 16 and ring 17 connected thereto by hinge 25 to rotate about hinge assembly 24 to the original position as shown in FIG. 1 before the tab was severed from the lid body along the score line. The tear tab is held in the close position in opening 30 by returning the section 17A of the tab control ring into a snap fit relation with the upstanding tabs 18. It has been found that by this construction and arrangement of parts, the tear tab is not only accurately but also consistently repositioned when in a closed position to form a fluid tight seal in opening 30. Important to the obtaining of this seal is the fact that the score line is relatively deep into the thickness of the lid body so as to avoid the occurrence of an irregular random or serrated type configuration to the sheared material. A score line depth of about 80% to 90% of the lid body thickness is suitably most plastic materials of suitable composition. By the deeply grooved configuration, a sharp tear line occurs to assure that a remaining peripheral edge of the lid body joins with the remaining portion of the beverage container lid so as to reestablish a fluid tight seal once the tear tab has been sheared loose from the lid body.

The present invention also provides that the hinge 25 is so situated at the outer surface of the tab control ring that flexing of this hinge causes an elongation of the plastic material comprising this hinge which shortens the distance between the hinge and tab 18 as compared with the dimensional relationship before the tab control ring was operated to sever the tear tab from the lid body.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A beverage container lid comprising:

a lid body surrounded by a peripheral skirt for seating attachment to a rim of a beverage container;

a tear tab defined by a score line in said lid body extending from a blunt nose portion projecting along the lid body to inboard termination sites at opposite sides of an inboard hinge joined to the lid body;

a tab control ring hinged to an outboard part of said tear tab opposite said inboard hinge for controllably positioning said tear tab; and means upstanding from said lid body at preselected sites to releasably engage said tab control ring for holding said tear tab in closed and re-closed positions relative to an opening formed by severing the tear tab along said score line in the lid body.

2. The beverage container lid according to claim 1 further including second means upstanding from said lid body at preselected sites to releasably engage said tab control ring for holding said tear tab in an opening position relative to an opening formed by severing the tear tab along said score line in said lid body.

3. The beverage container lid according to claim 2 wherein said inboard hinge includes spaced apart hinge recesses separated by a hinge bar for spacing said recesses apart by a distance generally corresponding to a thickness of said tab control ring.

4. A beverage container lid according to claim 2 wherein said second means upstanding of said lid comprises locking tabs.

5. The beverage container lid according to claim 1 wherein said inboard hinge includes spaced apart hinge recesses separated by a hinge bar for spacing said recesses apart by a distance generally corresponding to a thickness of said tab control ring.

6. A beverage container lid according to claim 1 wherein said means upstanding from said lid comprises locking tabs.

7. A beverage container lid comprising:

a lid body surrounded by a peripheral skirt for seating attachment to a rim of a beverage container;

a tear tab defined by a score line in said lid body extending from a blunt nose portion projecting along the lid body to inboard termination sites at opposite sides of an inboard hinge joined to the lid body;

a tab control ring hinged to an outboard part of said tear tab opposite said inboard hinge for controlling positioning said tear tab; and first and second means upstanding from said lid body at preselected sites to releasably engage said tab control ring for holding said tear tab in open and re-closed positions relative to an opening formed by severing the tear tab along said score line in the lid body. body.

8. The beverage container lid according to claim 7 wherein said first and second means includes spaced apart pairs of tabs.

9. The beverage container lid according to claim 8 wherein said spaced apart pairs of tabs include a pair of tabs for holding the tear tab closed by engaging an inboard facing edge of said tab control ring.

10. The beverage container lid according to claim 7 wherein said inboard hinge includes a spacer bar between spaced apart hinge lines.

11. The beverage container lid according to claim 7 further comprising an outboard hinge for pivotally attaching said tab control ring to said tear tab, said outboard hinge being attached to an outboard side of said tear tab when said tear tab is positioned to close an access opening in said lid body.

12. The beverage container lid according to claim 11 wherein said outboard hinge is attached to a periphery located nose part of said tear tab.

13. The beverage container lid according to claim 12 wherein said outboard hinge comprises plastic material and is situated at an outer surface of said tab control ring such that flexing of the outboard hinge elongates the plastic material thereof to thereby shorten the distance between said outboard hinge and said tear tab than existed before initial flexing of said outboard hinge to sever said tear tab.

* * * * *